US005322173A

United States Patent [19]

Kay

[11] Patent Number: 5,322,173

[45] Date of Patent: Jun. 21, 1994

[54] VENTILATED WOODEN CLOSET SHELF AND ITS METHOD OF CONSTRUCTION

[76] Inventor: Leslie A. Kay, 1522 NE. Quayside Ter., Miami, Fla. 33138

[21] Appl. No.: 895,715

[22] Filed: Jun. 9, 1992

[51] Int. Cl.[5] ..... A47F 5/08

[52] U.S. Cl. ..... 211/153; 108/180; 211/134

[58] Field of Search ..... 211/153, 90, 186, 187, 211/134; 108/111, 102, 90, 112, 114, 64, 65

[56] References Cited

U.S. PATENT DOCUMENTS

| | | | |
|---|---|---|---|
| 388,066 | 8/1888 | Murphy | 24/153 X |
| 525,723 | 9/1894 | Schambrue | 211/153 |
| 777,256 | 12/1904 | Holden | 211/153 |
| 1,376,111 | 4/1921 | O'Brien | 108/111 |
| 1,533,891 | 8/1924 | Oles | 211/153 X |
| 1,778,075 | 10/1930 | Harris | 211/153 |
| 2,568,148 | 9/1951 | Goldsmith | 211/153 |
| 3,070,237 | 12/1962 | Fullerton et al. | 211/187 X |
| 3,513,786 | 5/1970 | Kellogg | 211/153 X |
| 3,556,306 | 1/1971 | Shell | 211/90 |
| 4,078,664 | 3/1978 | McConnell | 211/187 X |
| 4,372,522 | 2/1983 | Simeonoff | 211/186 X |
| 4,589,350 | 5/1986 | Tapojarni | 108/111 |

*Primary Examiner*—David A. Scherbel
*Assistant Examiner*—Korie H. Chan

[57] ABSTRACT

A ventilated wooden closet shelf primarily for residential homes. The shelf, which may be made in any length, includes a wooden rear beam of uniform square or rectangular cross section and a wooden front beam of uniform cross section. Each of the two beams contain a flat vertical side which is drilled to form a line of equally spaced apart cylindrical holes. The shelf also includes a number of identical wooden shelf members, each of which has an elongated upper horizontal surface and at each end a cylindrical stub sized to fit into one of the holes in the front and rear beams. The spacing between the cylindrical holes is such that adjacent shelf members are spaced apart a distance of less than the width of the elongated horizontal upper surfaces of the shelf members to provide ventilation through the shelf.

4 Claims, 1 Drawing Sheet

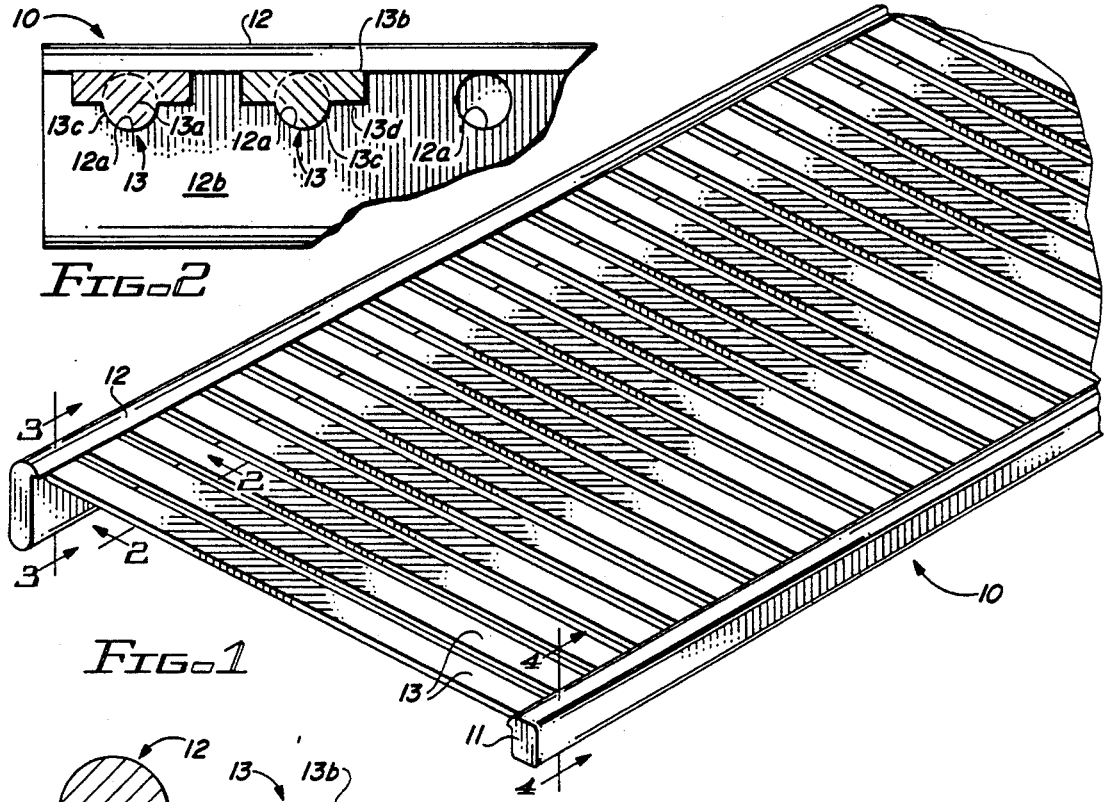
FIG. 2
FIG. 1
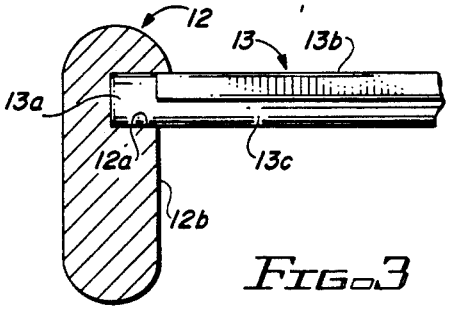
FIG. 3
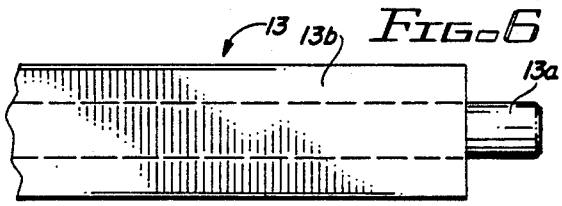
FIG. 6
FIG. 7
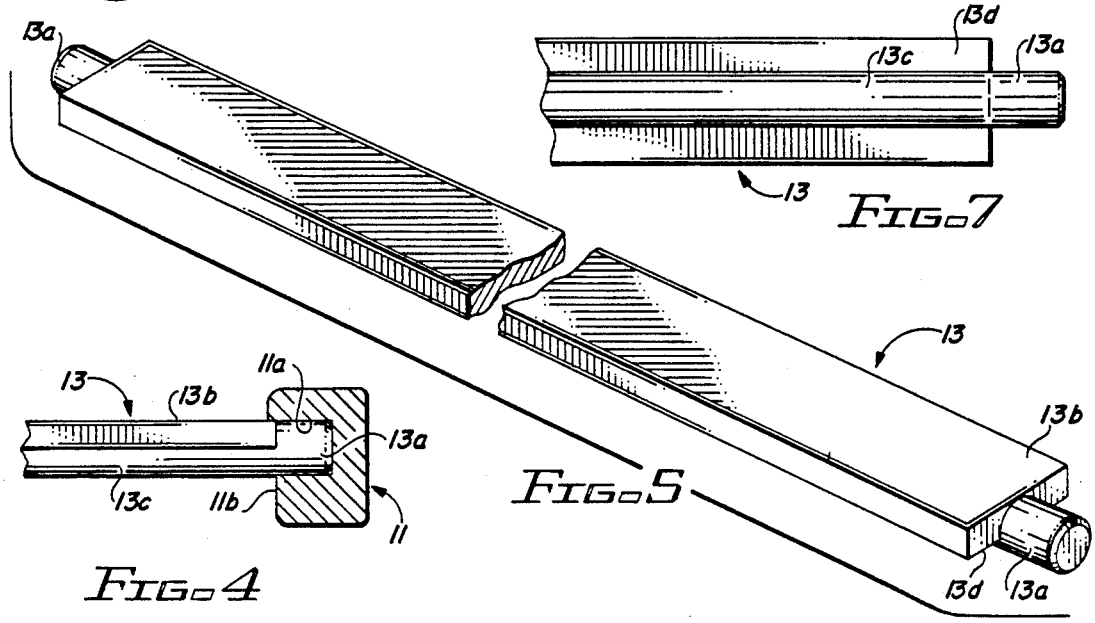
FIG. 5
FIG. 4

VENTILATED WOODEN CLOSET SHELF AND ITS METHOD OF CONSTRUCTION

BACKGROUND AND SUMMARY OF THE INVENTION

My invention lies in the field of shelving and more particularly to wooden closet shelving and the method of making a ventilated wooden closet shelf.

For many years shelving manufactured for use in closets for the storage of clothing and personal items in residential homes has consisted of what is called in the trade "wire goods" meaning shelving made of spaced apart steel rods coated with a plastic. While widely used, such wire goods are not particularly decorative and their plastic covering often deteriorates with a sticky or tacky surface which detracts from the use of wire goods as shelving in the closets of residential homes.

About seven or eight years ago wooden shelving began replacing wire goods as the preferred shelves in new residential homes, especially in higher priced homes. Home designers and the buying public wanted more elegant shelving and shelving whose surfaces did not deteriorate and become sticky with age.

Wooden closet shelving as it originally appeared on the market consisted of front and back beams or supports and a plurality of identical spaced apart wooden rods whose opposite ends were inserted into drilled holes in the front and back wooden beams. The back beam was affixed to the closet wall and the front beam supported by angled brackets affixed to the wall. A typical wooden closet shelf of the type first marketed in the 1980s is shown in Motta U.S. Pat. Des. No. 292,860 which issued Nov. 4, 1987.

Shelving consisting of a plurality of spaced apart wooden rods, such as shown in Motta U.S. Pat. Des. No. 292,860, did not provide a shelf surface convenient to the storage of many items conventionally stored on closet shelves. Moreover, the public preferred an essentially flat polished wood surface which was more pleasing to the eye than the cylindrical surfaces of a series of spaced apart wooden rods.

However, the use of a series of flat surfaced ruler-like members to provide the desired upper shelf surface of a wooden closet shelf added considerably to the cost of manufacturing the closet shelf. To rout out the elongated holes in the back and front beams of the shelf to accomodate the ends of the flat surfaced memebers is much more time consuming and expensive than drilling the cylindrical holes which accomodate the ends of cylindrical rods such as shown in Motta U.S. Pat. Des. No. 292,860.

I have invented a unique wooden closet shelf member which has all the advantages of the preferred upper flat shelf surface and opposite ends which can be fitted into inexpensively drilled cylindrical holes. In its preferred form, my unique wooden closet shelf member has an elongated rectangular flat horizontal upper surface lying immediately above a pair of elongated rectangular flat vertical surfaces. At each end of the elongated horizontal and vertical surfaces there is provided a cylindrical extension or stub member.

The cylindrical stubs on each end of the flat surfaced shelf member are sized to fit into the previously drilled cylindrical holes in both the front and back beams of the shelf. The holes drilled in the two beams are spaced apart one from the other a distance which is sufficient to provide spacing between the flat surfaced members so as to provide air movement between successive flat surfaced closet members.

DETAILED DESCRIPTION OF THE DRAWINGS

Appended to and made a part of the description of my invention is a sheet of drawings which illustrate a preferred embodiment of my ventilated wooden closet shelf.

FIG. 1 of the drawings is a perspective view of my unique wooden closet shelf.

FIG. 2 is a detailed view partially broken away taken along line 2—2 of FIG. 1.

FIG. 3 is a detailed view partially broken away taken along line 3—3 of FIG. 1.

FIG. 4 is a detailed view partially broken away taken along line 4—4 of FIG. 1.

FIG. 5 is a perspective view of one of the flat surfaced shelf members used to construct the closet shelf shown in FIG. 1.

FIG. 6 is a top plan view taken from above and partially broken away of one end of the shelf member shown in FIG. 5.

FIG. 7 is a lower plan view taken from below and partially broken away of one end of the shelf member shown in FIG. 5.

DETAILED DESCRIPTION OF A PREFERRED EMBODIMENT

Referring to FIG. 1 of the drawings, ventilated wooden closet shelf 10 includes rear beam 11, front beam 12, and a series of spaced apart flat surfaced shelf members 13.

Rear beam 11 is essentially rectangular in cross-section as best shown in FIG. 4 with smoothly rounded corners and its lower front side 11*b* slightly undercut as compared with that portion of beam 11 located above the cylindrical hole 11*a* in the front side of rear beam 11.

Front beam 12 has parallel vertical sides and semicircular upper and lower ends as best shown in FIG. 3. Similarly to rear beam 11, front beam 12 has the lower rear side 12*b* slightly undercut as compared with that portion of beam 12 located above the cylindrical hole 12*a* drilled into the rear side of front beam 12.

Shelf members 13 each have an elongated rectangular flat horizontal upper surface 13*b* and at each end a cylindrical stub 13*a* sized to fit into cylindrical holes 11*a* and 12*a* in rear beam 11 or front beam 12 respectively. As shown in FIGS. 2, 3, 4, 5, 6 and 7, lying immediately below upper surface 13*b* is a pair of elongated rectangular vertical surfaces and beneath each of these rectangular vertical surfaces is an elongated horizontal surface 13*d* lying parallel to upper surface 13*b*.

As shown in FIG. 2, 3, 4 and 7, a rounded extension 13*c* of the lower half of stub 13*a* forms the lowermost portion of shelf member 13 to provide a reinforcing support and to stabilize the shelf member. The uppermost edge of stub 13*a* lies just below the upper surface 13*b* of the shelf member as shown in FIGS. 2, 3 and 5.

The assembled closet shelf 10 shown in FIG. 1 presents a pleasing flat upper shelf surface made of polished wood provided with spaced rectangular vents. The inclusion of cylindrical stubs 13*a* on each end of shelf member 13 permits beams 11 and 12 to be economically drilled with cylindrical holes 11*a* and 12*a* sized to receive stubs 13*a*. This construction permits the manufacture of the assembled shelf 10 with considerable cost savings.

While I have shown and described a preferred embodiment of my unique ventilated closet shelf, no limitation of the spirit and scope of my invention should be inferred from this description. The scope of my invention is limited only by the appended claims.

I claim:

1. A ventilated wooden closet shelf comprising an elongated wooden rear beam of uniform cross section having at least one essentially flat vertical side, said rear beam having along said one flat vertical side a series of similar equally spaced apart cylindrical holes, an elongated wooded front beam of uniform cross section having at least one essentially flat vertical side, said front beam having along said one flat vertical side a series of similar equally spaced apart cylindrical holes, and a plurality of identical shelf members, each shelf member having an elongated flat horizontal upper surface and a lower surface, and at each end of each of said shelf members a cylindrical stub sized to fit into the cylindrical holes in the front and rear beams, and a semicircular extension portion connecting the stub at each end of the shelf member, and said semicircular extension portion extending directly below and along the length of said lower surface of said shelf member forming a lowermost portion of the shelf member.

2. A ventilated wooden closet shelf as set forth in claim 1 in which the rear beam is generally square in cross section.

3. A ventilated wooden closet shelf as set forth in claim 1 in which the front beam in cross section has two parallel vertical sides and upper and lower ends connecting the two vertical sides which are semicircular in form.

4. A ventilated wooden closet shelf as set forth in claim 1 in which the plurality of shelf members are spaced apart a distance which is less than the width of the flat

* * * * *

UNITED STATES PATENT AND TRADEMARK OFFICE

CERTIFICATE OF CORRECTION

PATENT NO. : 5,322,173

DATED : June 21, 1994

INVENTOR(S) : Leslie A. Kay

It is certified that error appears in the above-identified patent and that said Letters Patent is hereby corrected as shown below:

Column 3, line 16: "wooded" should read -- wooden --

Column 4, line 22: After the word "flat" add --
horizontal upper surface of the shelf members—.

Signed and Sealed this

Thirteenth Day of September, 1994

*Attest:*

*Attesting Officer*

Bruce Lehman

BRUCE LEHMAN

*Commissioner of Patents and Trademarks*